US010643475B2

(12) United States Patent
Sim

(10) Patent No.: US 10,643,475 B2
(45) Date of Patent: May 5, 2020

(54) LANE DEPARTURE WARNING DEVICE AND METHOD

(71) Applicant: MANDO CORPORATION, Gyeonggi-do (KR)

(72) Inventor: Sang Kyun Sim, Gyeonggi-do (KR)

(73) Assignee: MANDO CORPORATION, Gyeonggi-Do (KR)

( * ) Notice: Subject to any disclaimer, the term of this patent is extended or adjusted under 35 U.S.C. 154(b) by 0 days.

(21) Appl. No.: 16/265,995

(22) Filed: Feb. 2, 2019

(65) Prior Publication Data

US 2019/0172356 A1 Jun. 6, 2019

Related U.S. Application Data

(63) Continuation of application No. 15/349,995, filed on Nov. 11, 2016, now Pat. No. 10,249,195.

(30) Foreign Application Priority Data

Nov. 20, 2015 (KR) ..... 10-2015-0163038

(51) Int. Cl.
*G08G 1/16* (2006.01)

(52) U.S. Cl.
CPC ..... *G08G 1/167* (2013.01)

(58) Field of Classification Search
CPC ... G06K 9/00798; G08G 1/167; B60W 30/12; B62D 15/029
See application file for complete search history.

(56) References Cited

U.S. PATENT DOCUMENTS 8,504,233 B1 * 8/2013 Ferguson ..... G06K 9/00798 701/23
2007/0041614 A1 2/2007 Tanji
2007/0263902 A1 11/2007 Higuchi et al.
2009/0164083 A1 6/2009 Thiel
2012/0212612 A1 * 8/2012 Imai ..... G06K 9/00798 348/148

(Continued)

FOREIGN PATENT DOCUMENTS

CN 103582907 2/2014

OTHER PUBLICATIONS

Office Action dated Nov. 5, 2018 for Chinese Application No. 201611042341.0 and its English translation by Global Dossier.

(Continued)

*Primary Examiner* — Omeed Alizada
(74) *Attorney, Agent, or Firm* — Ladas & Parry, LLP

(57) ABSTRACT

The present invention relates to a lane departure warning device or the like that limits a lane departure warning in a special road environment, in a case where it is confirmed that a driver has a lane departure intention, and so on. It is possible to secure the reliability of a lane departure warning system and to provide a driver's convenience by limiting the lane departure warning in the case where the vehicle enters into a special road region, such as a road junction/branch region by comprehensively considering information captured by a camera of the vehicle, navigation map information, and so on while using a general lane departure warning, and also limiting the lane departure warning even in the case where the driver's lane departure intention is confirmed.

18 Claims, 11 Drawing Sheets

(56) References Cited

U.S. PATENT DOCUMENTS

| | | | | |
|---|---|---|---|---|
| 2017/0109590 | A1* | 4/2017 | Gehrke | G06K 9/00791 |
| 2017/0148327 | A1 | 5/2017 | Sim | |

OTHER PUBLICATIONS

Notice of Allowance dated Dec. 11, 2018 for U.S. Appl. No. 15/349,995 (now published as US 2017/0148327).
Final Office Action dated Jul. 17, 2018 for U.S. Appl. No. 15/349,995 (now published as US 2017/0148327).
Non-Final Office Action dated Feb. 7, 2018 for U.S. Appl. No. 15/349,995 (now published as US 2017/0148327).

* cited by examiner

LANE DEPARTURE WARNING DEVICE AND METHOD

CROSS REFERENCE TO RELATED APPLICATIONS

This application is a continuation of U.S. patent application Ser. No. 15/349,995, filed on Nov. 11, 2016, which claims priority to Korean Patent Application No. 10-2015-0163038, filed on Nov. 20, 2015, which are hereby incorporated by reference for all purposes as if fully set forth herein.

BACKGROUND OF THE INVENTION

1. Field of the Invention

The present invention relates to a lane departure warning device and method of a vehicle, and more particularly, to a technology of limiting lane departure warnings in a special road environment in a case where it is confirmed that a driver has a lane departure intention, and so on.

2. Description of the Prior Art

An electric power steering apparatus of a vehicle includes a torque sensor configured to sense the torque of a steering shaft connected to a steering wheel, an electric motor linked with a steering output shaft or a rack bar to rotate/move the steering output shaft or the rack bar, a steering ECU configured to control the rotation of the electric motor according to a steering torque value measured by the torque sensor, and so on.

The electric power steering apparatus basically performs an operation of generating a steering assist current to be proportional to the steering torque according to a driver's operation of the steering wheel so as to rotate the electric motor. That is, the electric power steering apparatus performs a basic operation for assisting the user's steering force.

However, according to the development of a Driving Assistance System (DAS) and a demand for autonomous traveling or the like, an autonomous steering control or an active steering control has been recently developed which automatically operates the electric power steering system regardless of the user's intention, in addition to a basic function of simply assisting the driver's steering force.

According to the autonomous steering control or the active steering control, there are various control systems related to steering, which affect the electric power steering system of a vehicle.

An example of the control system related to the steering of a vehicle includes a Lane Keeping Assistance System (LKAS) configured to sense a lane to control the vehicle to travel along the lane, and to operate a steering system regardless the driver's operation to keep the lane when lane departure is concerned.

In addition, there is a Lane Departure Warning System (LDWS) configured to sense a lane and the current position of the vehicle and to then warn of a lane departure state when the vehicle departs from a predetermined range adjacent to the lane.

Of course, the above mentioned LKAS and LDWS may be integrated with each other so as to implement a single system, and in such an integrated lane control system may include both of a function of making a warning when there is the possibility of a lane departure and a function of actively controlling the steering systems to keep the lane.

When a system having the lane departure warning device is used, too many lane departure warnings may occur depending on a driver's driving habits.

In a case where the vehicle may frequently come closer to a lane (e.g., a case where the driver intentionally changes lanes in practice, or a case where the driver is a beginning driver so that it is difficult to travel in the center of the traveling way), a lane departure warning is generated whenever the vehicle comes close to the lane, which may disturb driving.

In consideration of this point, in the past, there has been proposed a technology of not generating a lane departure warning when it is possible to keep the lane by a lane keeping system even if the vehicle enters a lane departure warning occurrence area, when the driver's lane change intention is securely confirmed, and so on.

Even in a special situation, such as a joining road or a branch road, it may be necessary to limit the lane departure warning, but no technology has been proposed for this problem.

SUMMARY OF THE INVENTION

In this background, an object of the present invention is to provide a lane departure warning device that is capable of improving the reliability of the lane departure warning by using a camera and navigation map information.

Another object of the present invention is to provide a lane departure sensing device that is improved in terms of the reliability of a lane departure warning by using a front camera and navigation map information in such a manner that when the camera has a functional failure, the lane departure function is deactivated, and when less than two lanes are detected, the lane departure warning is limited.

Another object of the present invention is to provide a lane departure warning device that is improved in terms of the reliability of a lane departure warning by confirming a junction point or branch point of a road on which the vehicle is traveling at present by using one or both of a front camera and navigation map information of a vehicle, and then limiting the lane departure warning at the time of entering the junction point or branch point.

Another object of the present invention is to provide a lane departure warning device that is improved in terms of the reliability of a lane departure warning by confirming whether the vehicle enters into a warning limit condition (e.g., enters into a crossroad section, enters into a tollgate/Hi-pass section, or enters into a crosswalk region) by using one or more of a front camera and navigation map information of a vehicle, and limiting the lane departure warning when it is confirmed that the vehicle enters into the warning limit condition.

Another object of the present invention is to provide a lane departure warning device that is improved in terms of the reliability of a lane departure warning by confirming whether the driver has a lane departure intention based on information, such as the vehicle's transverse velocity, transverse acceleration, longitudinal acceleration, heading angle, steering angle, steering angle speed, operation/non-operation of a turn signal, and operation/non-operation of a hazard signal, and limiting the lane departure warning when it is confirmed that the driver has a lane departure intention.

In order to achieve the above-described objects, one embodiment of the present invention provides a lane departure warning device. The lane departure warning device may include: a lane recognizing unit configured to recognize a lane line of a lane on which a vehicle is traveling by using image information captured by a camera; a fail-safe unit configured to determine whether a camera has a functional failure, and to deactivate a lane departure warning function when it is determined that the camera has a functional failure; a lane departure warning unit configured to determine whether the vehicle departs from the lane line according to a relative position between the vehicle and the recognized lane line; a first warning limit unit configured to confirm at least one of a road junction region and a road branch region in front of the vehicle by using at least one of the image information captured by the camera and navigation map information, and then, to limit the lane departure warning when the vehicle enters into the road junction region or the road branch region; and a second warning limit unit configured to confirm a driver's lane departure intention by using information including at least one of the vehicle's transverse velocity, transverse acceleration, longitudinal acceleration, heading angle, steering angle, steering angle speed, operation/non-operation of a turn signal, and operation/non-operation of a hazard signal, and to limit the lane departure warning when the driver's lane departure intention is confirmed.

A lane departure warning device of another embodiment of the present invention may include: a lane recognizing unit configured to recognize a lane line of a lane on which a vehicle is traveling by using image information captured by a camera; a lane departure warning unit configured to determine whether the vehicle departs from the lane line according to a relative position between the vehicle and the recognized lane line; and a first warning limit unit configured to determine at least one of a road junction region and a road branch region in front of the vehicle by using at least one of the image information captured by the camera and navigation map information, and then, to limit the lane departure warning when the vehicle enters into the road junction region or the road branch region.

Another embodiment of the present invention provides a lane departure warning method. The lane departure warning method may include: a lane recognizing step of recognizing a lane line around a lane on which a vehicle is traveling by using image information captured by a camera; a lane departure warning step of determining whether the vehicle departs from the lane line according to a relative position between the vehicle and the recognized lane line; a first warning limit step of confirming at least one of a road junction region and a road branch region in front of the vehicle by using at least one of the image information captured by the camera and navigation map information, and then, limiting the lane departure warning when the vehicle enters into the road junction region or the road branch region; and a second warning limit step of confirming a driver's lane departure intention by using information including at least one of the vehicle's transverse velocity, transverse acceleration, longitudinal acceleration, heading angle, steering angle, steering angle speed, operation/non-operation of a turn signal, and operation/non-operation of a hazard signal, and then, limiting the lane departure warning when the driver's lane departure intention is confirmed.

According to the present invention to be described hereinafter, it is possible to improve the reliability of lane departure warning of a lane departure warning device by using a camera and navigation map information in such a manner that when the camera has a functional failure, the lane departure warning function is deactivated, and limiting the lane departure warning when less than two lanes are detected.

In addition, it is possible to improve the reliability of a lane departure warning device by confirming one or more warning limit conditions, such as the vehicle's entry into a junction point or branch point, a crossroad section, entry into a tollgate/Hi-pass section, and entry into a crosswalk region by using at least one of the front camera of a vehicle and navigation map information and then limiting the lane departure warning when the vehicle enters into the warning limit conditions.

Further, when using the present invention, it is possible to further improve the reliability of a lane departure warning by confirming whether the driver has a lane departure intention based on information, such as the vehicle's transverse velocity, transverse acceleration, longitudinal acceleration, heading angle, steering angle, steering angle speed, operation/non-operation of a turn signal, and operation/non-operation of a hazard signal, even though it does not correspond to the warning limit conditions as described above, and limiting the lane departure warning when it is confirmed that the driver has a lane departure intention.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Figure 1:
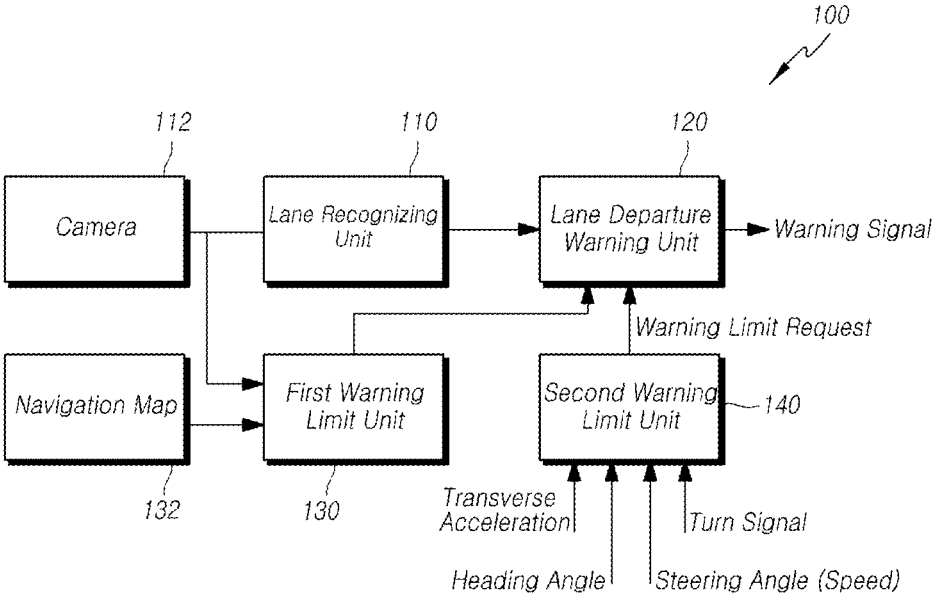
FIG. 1 illustrates an entire configuration of a lane departure warning device according to one embodiment of the present invention.

Hereinafter, exemplary embodiments of the present invention will be described with reference to the accompanying drawings. In adding reference numerals to elements in each drawing, the same elements will be designated by the same reference numerals, if possible, although they are shown in different drawings. Further, in the following description of the present invention, a detailed description of known functions and configurations incorporated herein will be omitted when it is determined that the description may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 illustrates an entire configuration of a lane departure warning device according to one embodiment of the present invention.

A lane departure warning device 100 according to the present invention is a device implemented in a vehicle including a camera 112 having a lane line recognizing function and a navigation device 132 having map information.

The lane departure warning device 100 may include: a lane recognizing unit 110 configured to recognize a lane line adjacent to a vehicle's traveling road by using information captured by a camera; a lane departure warning unit 120 configured to determine whether a vehicle departs from the recognized lane line according to a relative position between the recognized lane and the vehicle, and to make a warning when it is determined that the vehicle departs from the lane; a first warning limit unit 130 configured to determine a road junction or branch region in front of the vehicle by using image information captured by the camera and navigation map information, and to make a control to limit a lane departure warning when it is determined that the vehicle enters into the road junction or branch region; and a second warning limit unit 140 configured to confirm whether the driver has a lane departure intention after receiving measurement information from various sensors of the vehicle, and to make a control to limit a lane departure warning when it is confirm that the driver has a lane departure intention.

In addition, although not illustrated, the lane departure warning device 100 may further include a fail-safe unit configured to determine whether a camera has a functional failure, and to deactivate the lane departure warning function when it is determined that the camera has a functional failure.

Hereinbelow, respective components will be described in detail, which constitute the lane departure warning device according to the present invention.

The camera 112 mounted on the vehicle may be a front camera that is installed, e.g., behind a vehicle wind shield to capture an image of a frontward view of the vehicle, and may include all the types of photographing means, such as a CCD type and a MOSFET type.

The term "camera" may be a concept that covers an imaging module that processes a captured image to output information, such as a position, a kind, and a distance of an object in the image, in addition to a simple image capturing function.

The navigation device 132 is a traveling assistance device that includes map information, and is configured to sense the current position of the vehicle by using a positioning means, such as GPS, and to then display the current position information and traveling-related information of the vehicle together with the map information.

The navigation device 132 may be a type embedded in the vehicle or a type additionally mounted on the vehicle as a separate device, and the present invention may adopt both the types of navigation devices.

However, the navigation device applicable to the present invention should include map information therein, and should be provided with a function of transmitting map information by the lane departure warning device according to the present device by using a predetermined information transmission/reception means (e.g., a wireless communication module or a wired communication cable).

More specifically, the information to be transmitted to the lane departure warning device by the navigation device 132 according to the present invention may be lane number information in the traveling road, intersection region information in the traveling road, crosswalk region information, tollgate or Hi-pass region information, road junction or branch region information, and so on.

The lane recognizing unit 110 functions to recognize a lane line existing in the traveling road by using output information transmitted from the camera.

The lane recognizing unit 110 removes an obstacle from the image on the basis of distance data acquired by a distance sensor, sets the region, from which the obstacle is removed, as a free space, and detects an edge of the image within the free space.

A predetermined edge detection algorithm may be used for detecting the edge, and in the present invention, a Sobel filter may be, but not exclusively, used, which is more effective for detecting a diagonal edge than a vertical edge or a horizontal edge.

When an edge (e.g., a horizontal edge, a vertical edge, or a diagonal edge) of an object included in the image is detected, a straight line component is detected from the edge information using a Hough transform algorithm.

Then, based on the detection result of the straight line component detection within the free space, the lane recognizing unit 110 sets at least one Region of Interest (RoI) required for recognizing a lane line.

The RoI required for recognizing a lane line is set to include a lane line, and to minimize an image search range for recognizing the lane line. In general, because the lane lines are positioned in the lower portion of the image, the RoI is set in the lower side of the image. In addition, because the lane lines appear smaller as distance to the lanes increases, the RoI may be set such that the size of the RoI also becomes smaller as the lane lines become smaller.

In addition, because the lane lines include a left lane line and a right lane line of a traveling road, the RoI may be set for each of the left lane line and the right lane line.

When an RoI for recognizing a lane line is set, the lane recognizing unit 110 extracts a lane line from the set RoI, and when the lane line is extracted from the RoI, the lane recognizing unit 110 may detect a vanishing point of the lane line.

By comparing the position of the detected vanishing point to the position of the central point of the image, it is possible to estimate the heading angle of the vehicle. That is, when the vanishing point of the lanes at the opposite sides of the traveling road coincides with the central point of an image captured by the camera, it indicates that the heading angle of the vehicle is zero (0), and the vehicle travels in the same direction as the advancing direction of the road, and the heading angle of the vehicle, which indicates an angle between the traveling direction of the vehicle and the advancing direction of the lanes, may be estimated from the offset between the vanishing point and the central point of the image.

Meanwhile, as will be described later, the lane departure warning device according to the present invention should be able to sense a distant lane line in the vanishing side direction after sensing a lane "vanishing" state in which one of the lane lines of both sides of a traveling road is suddenly non-recognized in the middle of being recognized.

For this purpose, the lane recognizing unit 110 has a function of enlarging the RoI to the vanishing side direction when one of the lane lines of both sides of the traveling road vanishes.

That is, RoIs having the same size are set on the both sides of the traveling road in an ordinary traveling state. However, when one of the lane lines of both sides of the traveling road vanishes, the RoI to the vanishing side direction is further enlarged so that the vanishing side distant lane line that exists at the far distance can be recognized.

Of course, as will be described later, there is also a case where the RoI in the non-vanishing side direction is further enlarged when the vehicle travels along a road that branches from a road branch region. Thus, the lane recognizing unit 110 according to the present invention has a function of enlarging and resetting the RoIs to both of the vanishing side and the non-vanishing side when one of the lane lines of both sides of the traveling road vanishes.

In addition, the lane recognizing unit 110 may have a function of calculating a distance to a lane line included in a image frame captured in consideration of the focal distance and magnification of the camera.

The lane departure warning unit 120 performs functions of determining whether the vehicle departs from the lane according to a relative position between the recognized lane line and the vehicle, and giving a warning when it is determined that the vehicle departs from the lane.

Figure 3:
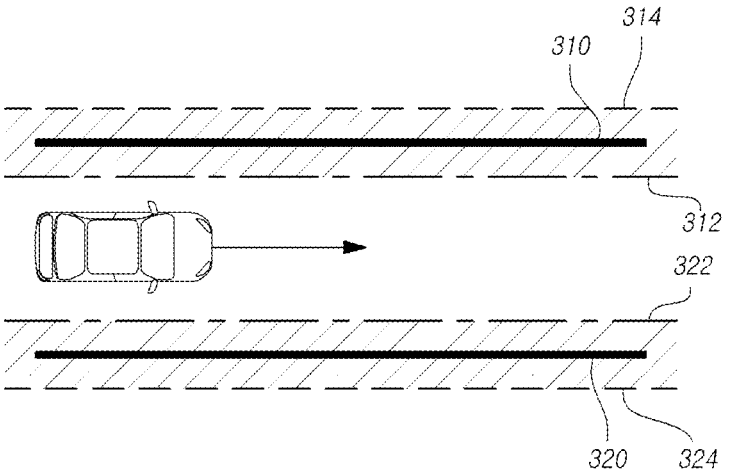
FIG. 3 illustrates a departure region determination algorithm of a lane departure warning unit.

FIG. 3 illustrates a departure region determination algorithm of the lane departure warning unit 120.

As illustrated in FIG. 3, with reference to lane lines 310 and 320 recognized at the both sides of a road on which the vehicle is traveling at present, the lane departure warning unit 120 sets inner warning lines (earliest warning lines) 312 and 322 that are spaced inwardly away from the recognized lane lines 310 and 320 by a predetermined inward spacing distance, respectively, and outer warning lines (latest warning lines) 314 and 324 that are spaced outwardly away from the recognized lane lines 310 and 320 by a predetermined outward spacing distance, respectively.

The spaces between the inner warning lines 312 and 322 and the outer warning lines 314 and 324 are departure warning regions (hatched portions in FIG. 3). When the departure warning is initiated at the time when the vehicle enters into the departure warning region, and the departure warning is continued until the vehicle departs from the departure warning region.

That is, the departure warning is initiated when the front wheel of the vehicle enters into the departure warning region, and when the rear wheel of the vehicle departs from the departure warning region, the departure warning is released.

In this case, the inward spacing distance and the outward spacing distance, which are the basis for the departure warning region, may be differently set depending on the speed of the vehicle, precision of lane departure, and so on.

For example, when the speed of the vehicle is high, the vehicle may more rapidly departs from the lane and the danger caused by the lane departure, the inner spacing distance and the outer spacing distance may be set to be large, and when the speed of the vehicle is low, the inner spacing distance and the outer spacing distance may be set to be relatively small.

The first warning limit unit 130 basically includes a function of determining a front road junction or branch region by using image information captured by a camera and navigation map information, and then making a control to limit a lane departure warning when it is determined that the vehicle enters into the road junction or branch region.

Meanwhile, in addition to the function of determining the junction/branch region as described above, the first warning limit unit 130 may further include a function of confirming one or more warning limit conditions among the vehicle's entry into a crossroad section, entry into a tollgate/Hi-pass section, and entry into a crosswalk region by using at least one of the vehicle's front camera and navigation map information, and then limiting the lane departure warning when the vehicle enters into any of the warning limit conditions.

Figure 2:
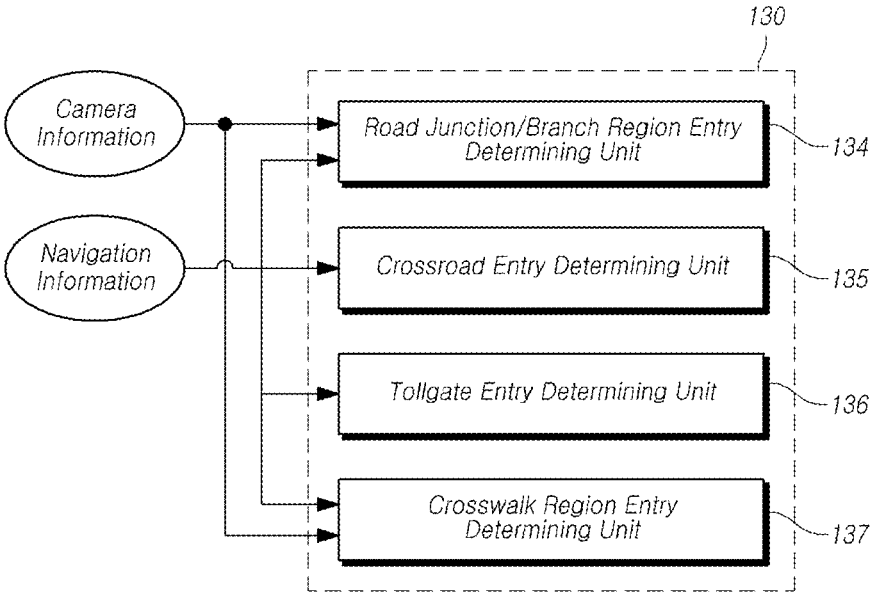
FIG. 2 is a block diagram illustrating detailed functions of a first warning limiting unit included in the lane departure warning device according to the present invention.

FIG. 2 is a block diagram illustrating detailed functions of a first warning limiting unit 130 included in the lane departure warning device according to the present invention.

As illustrated in FIG. 2, the first warning limit unit 130 may include a road junction/branch region entry determining unit 134, a crossroad entry determining unit 135, a tollgate entry determining unit 136, a crosswalk region entry determining unit 137, and so on.

When one of the lane lines of the both sides of the lane on which the vehicle is traveling at present vanishes, the road junction/branch region entry determining unit 134 may: recognize a distant lane line that exists at the vanishing side or non-vanishing side using image information captured by the camera; then calculate a vehicle approach rate, which is a rate of change of the distant lane line that approaches the vehicle while the distant lane line is recognized for a predetermined distance or a vehicle departure rate, which is a rate of change of the distant lane line that departs from the vehicle while the distant lane line is recognized for a predetermined distance; and determine whether the road joins or branches on the basis of the vehicle approach rate or the vehicle departure rate.

The method of determining entry into the road junction/branch region will be described in more detail below with reference to FIGS. 4 and 5.

FIG. 4 illustrates an example of a method of determining entry into a road junction region according to the present invention.

Hereinafter, an event in which one of the lane lines of both sides of a lane on which the vehicle is traveling is suddenly non-recognized in the middle of being recognized by the lane recognizing unit 110 will be referred to as "lane line vanishing" for the convenience of description.

Figure 4A:
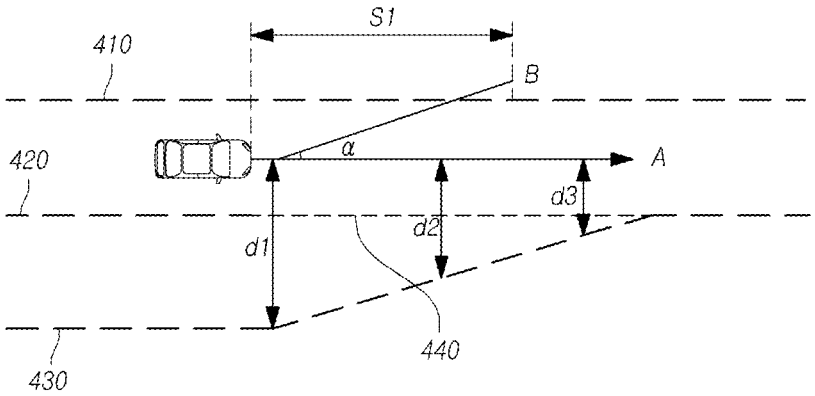
FIGS. 4A and 4B illustrate an example of a method of determining entry into a road junction region according to the present invention.
Figure 4B:
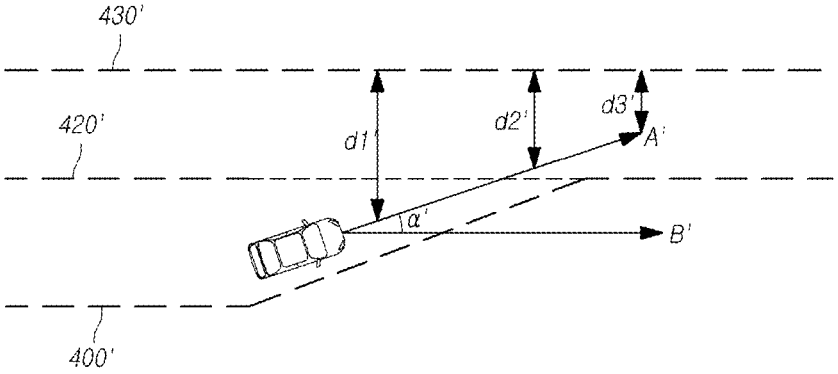

In a region where a road joins as illustrated in FIGS. 4A and 4B, a lane line is not recognized properly, and a conventional lane departure system generates a virtual lane line 420 at the side where the lane line is not recognized, and then continuously applies the lane departure algorithm.

However, in the road junction region, even though the vehicle is not in the practical lane departure state, a lane departure warning may be generated, which may make trouble for the driver, and the first warning limit unit 130 may be operated in such a case.

As in FIGS. 4A and 4B, let us assume a case in which, in a state where the lane recognizing unit recognizes the lane lines 410 and 420 of the both sides of the lane on which the vehicle is running, the lane recognizing unit suddenly fails to recognize the right lane line 420, i.e., the right lane vanishes.

In such a case, the first warning limit unit 130 controls the lane recognizing unit 110 to enlarge the RoI at the vanishing side, and thereby senses the distant lane line 430 existing at the vanishing side (hereinafter, the distant lane line 430 may also be referred to as "vanishing side distant lane line 430").

The first warning limit unit 130 senses the change state of the vanishing side distant lane line 430 and calculates a vehicle approach rate, which is a rate of change by which the vanishing side distant lane line 430 approaches the vehicle.

The vehicle approach rate of the vanishing side distant lane line 430 may be represented by the variation amount per time (dd/dt) of vertical distances d1, d2, d3 between the vehicle and the vanishing side distant lane line 430, which are measured by the lane recognizing unit.

In addition, the vehicle approach rate of the vanishing side distant lane line 430 may also be defined by a first angle $\alpha$ between the vehicle's traveling direction A and the vanishing side distant lane line 430 extension direction B.

The first warning limit unit 130 determines that the vehicle enters into a road junction region only when the calculated vehicle approach rate of the vanishing side distant lane line 430 is equal to or larger than a threshold value for the preset vehicle approach rate (hereinafter, the threshold value may also be referred to as "approach threshold value").

For example, when the approach threshold value is set to 0.2 m/sec or 20 degrees, it is determined that the vehicle enters into a road junction region only when the variation amount per time (dd/dt) of the vertical distances d1, d2, d3 between the vehicle and the vanishing side distant lane line 430 is 0.2 m/sec or more, or when a state in which the first angle $\alpha$ between the vehicle's traveling direction A and the vanishing side distant lane line extension direction B is 20 degrees or more is maintained for a predetermined first determination distance S1.

In this case, the first warning limit unit may determine that the vehicle enters into the road junction region only when the vanishing side distant lane line 430 is sensed, and then the vehicle approach rate of the vanishing side distant lane line 430 is a predetermined threshold or more for the predetermined first determination distance S1.

When it is determined that the vehicle enters into a road junction region as described above, the first warning limit unit 130 controls the lane departure warning unit 120 to prevent lane departure warning.

Meanwhile, FIG. 4A illustrates a case in which a road junction region exists in front of the vehicle and the vehicle travels along a lane that is maintained after joining, and FIG. 4B illustrates a case in which the vehicle travels along a lane that vanishes after joining.

As illustrated in FIG. 4A, when the vehicle travels along the lane that is maintained after joining, the road junction is determined as described above so that the lane departure warning may be limited, which will not be further described in order to avoid duplicating description.

Meanwhile, when the vehicle travels along a lane that joins to vanish (the lane defined by the lane line 420' and the lane line 400'), the left line 420' of the lane on which the vehicle is traveling suddenly becomes non-recognized in the middle of being recognized.

In such a case, the first warning limit unit 130 recognizes the distant lane line 430' existing in the vanishing side direction by enlarging the vanishing side RoI of the lane recognizing unit.

At this time, the vanishing side distant lane line becomes the left lane line of an adjacent lane located adjacent to the lane on which the vehicle is traveling.

Meanwhile, because the vehicle is traveling along the lane that joins to vanish, the vanishing side distant lane line 430' approaches the vehicle at a constant rate even though the vanishing side distant lane line 430' extends in a straight line direction.

Accordingly, the first warning limit unit 130 calculates the vehicle approach rate, which is a rate of change of the vanishing side distant lane line 430 that approaches the vehicle in a manner similar to that in FIG. 4A.

That is, the vehicle approach rate of the vanishing side distant lane line 430' is calculated based on the variation amount per time (dd'/dt) of the vertical distance d1', d2', d3' between the vehicle and the vanishing side distant lane line 430' or the first angle $\alpha'$ between the vehicle's traveling direction A' and the vanishing side distant lane line extension direction B'.

In addition, the first warning limit unit 130 determines that the vehicle enters into a road junction region only when the calculated vehicle approach rate of the vanishing side distant lane line 430' is equal to or larger than a preset approach threshold value, and limits the lane departure warning.

Figure 5A:
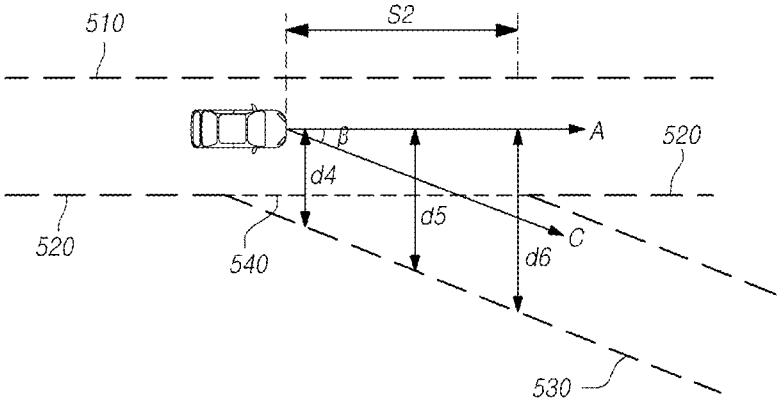
FIGS. 5A and 5B illustrate an example of a method of determining entry into a road branch region according to the present invention.
Figure 5B:
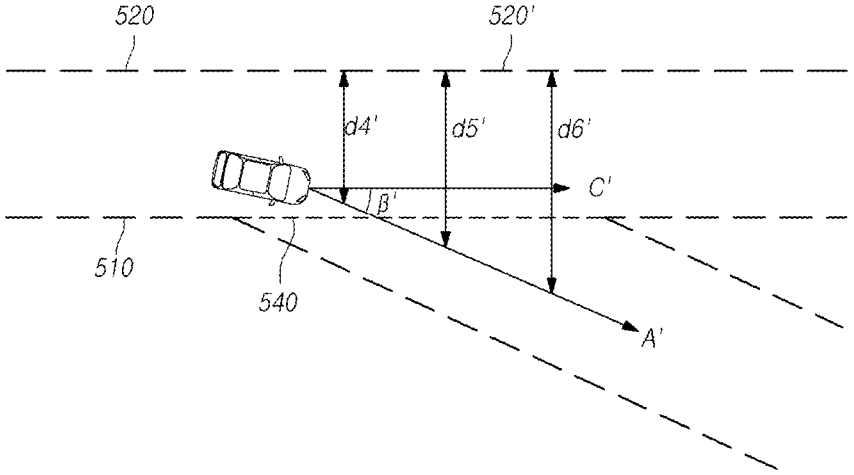

FIGS. 5A and 5B illustrate an example of a method of determining entry into a road branch region according to the present invention.

Like the road junction, in a region where one road branches into two or more roads as illustrated in FIGS. 5A and 5B, a lane line is not recognized properly, and a conventional lane departure system generates a virtual lane line 540 at the side where the lane line is not recognized, and then continuously applies the lane departure algorithm.

However, in the road branch region, even though the vehicle is not in the practical lane departure state, a lane departure warning may be generated, which may make trouble for the driver, and the first warning limit unit 130 may be operated in such a case.

Meanwhile, the case where a road branches may be divided into a case where a vehicle continuously travels along a maintained lane on which the vehicle is traveling at present and a case where a vehicle travels along a branch road, in which the former case is illustrated in FIG. 5A and the latter case is illustrated in FIG. 5B.

As illustrated in FIG. 5A, in the case where the vehicle travels along the maintained lane, when the vehicle enters into the branch region in the state where the lane recognizing unit recognizes the lane lines 510 and 520 of the both sides of the lane on which the vehicle is traveling at present, the right lane line 520 is suddenly non-recognized, i.e., vanishes.

In such a case, the first warning limit unit 130 controls the lane recognizing unit 110 to enlarge the vanishing side RoI such that the distant lane line 530 existing at the vanishing side is sensed.

In this case, the vanishing side distant lane line 530 may become the right lane line of the branch lane.

The first warning limit unit 130 senses the change state of the distant lane line 530 existing at the vanishing side so as to calculate a vehicle departure rate, which is a rate of change of the vanishing side distant lane line 530 that moves away from the vehicle.

The vehicle departure rate of the vanishing side distant lane line 530 may be represented by the variation amount per time (dd/dt) of vertical distances d4, d5, d6 between the vehicle and the vanishing side vehicle distant lane line 530, which are measured by the lane recognizing unit.

Alternatively, the vehicle departure rate of the vanishing side distant lane line 530 may also be defined by a second angle β between the vehicle's traveling direction A and the vanishing side distant lane line extension direction C.

The first warning limit unit 130 determines that the vehicle enters into a road branch region only when the calculated vehicle departure rate of the vanishing side distant lane line 530 is equal to or larger than a threshold value for the preset vehicle departure rate (hereinafter, the threshold value may also be referred to as "departure threshold value").

In this case, the first warning limit unit may determine that the vehicle enters into the road branch region only when the vanishing side distant lane line 530 is sensed, and then the vehicle departure rate of the vanishing side distant lane line 530 is a predetermined departure threshold value or more for the predetermined second determination distance S2.

In particular, unlike FIG. 5B to be described below, when the vehicle departure rate of the vanishing side distant lane line 530 is equal to the departure threshold value or more, it may be determined that the vehicle travels along a maintained road that is maintained after the road branch region.

When it is determined that the vehicle enters into a road branch region as described above, the first warning limit unit 130 controls the lane departure warning unit 120 to prevent lane departure warning.

Meanwhile, as illustrated in FIG. 5B, in the case where the vehicle travels along a branched lane, when the vehicle enters into the branch region in the state where the lane recognizing unit recognizes the lane lines 510 and 520 of the both sides of the lane on which the vehicle is traveling at present, the right lane line 520 is suddenly non-recognized, i.e., vanishes.

In this case, the first warning limit unit 130 controls the lane recognizing unit 110 to enlarge a non-vanishing side RoI that is located the opposite side to the vanishing side such that a distant lane line 520' existing in the direction of the non-vanishing side may be sensed.

In this case, the non-vanishing side distant lane line 520' is the left side lane line of the maintained lane that is maintained after branching.

Next, the first warning limit unit 130 senses the change state of the distant lane line 520' existing at the non-vanishing side so as to calculate a vehicle departure rate, which is a rate of change of the non-vanishing side distant lane line 520' that moves away from the vehicle.

The vehicle departure rate of the non-vanishing side distant lane line 520' may be represented by the variation amount per time (dd'/dt) of vertical distances d4', d5', d6' between the vehicle and the non-vanishing side vehicle distant lane line 520, which are measured by the lane recognizing unit.

Alternatively, the vehicle departure rate of the non-vanishing side distant lane line 520' may also be defined by a second angle β, between the vehicle's traveling direction A and the non-vanishing side distant lane line extension direction C'.

The first warning limit unit 130 determines that the vehicle enters into a road branch region only when the calculated vehicle departure rate of the non-vanishing side distant lane line 520' is equal to or larger than a threshold value for the preset vehicle departure rate (hereinafter, the threshold value may also be referred to as "departure threshold value").

In this case, the first warning limit unit may determine that the vehicle enters into the road branch region only when the non-vanishing side distant lane line 520' is sensed, and then the vehicle departure rate of the non-vanishing side distant lane line 520' is a predetermined departure threshold value or more for the predetermined second determination distance S2, and may limit the lane departure warning.

In particular, unlike FIG. 5A described below, when the vehicle departure rate of the non-vanishing side distant lane line 520' is equal to the departure threshold value or more, it may be determined that the vehicle travels along a branch road that branches from the road branch region.

That is, the first warning limit unit 130 of the present invention may determine whether the vehicle travels along a maintained road that is maintained after branching, or a branch road that branches after branching, in addition to determining the road branch region.

Specifically, when one of lane lines of the both sides of the traveling road vanishes, the first warning limit unit 130 recognizes the vanishing side distant lane line or non-vanishing side distant lane line, and calculates a vehicle departure rate of one of the vanishing side distant lane line and the non-vanishing side distant lane line. When the vehicle departure rate of the vanishing side distant lane line is the departure threshold value or more for the second determination distance, it is determined that the vehicle travels along the original traveling road (maintained road) from the road branch region. When the vehicle departure rate of the non-vanishing side distant lane line is the departure threshold value or more, it is determined that the vehicle enters into a branch road that branches from the road branch region.

Of course, the lane departure warning device according to the present invention does not make a lane departure warning in a branch region, as described above. Further, the lane departure warning device may determine whether the vehicle advances to the maintained road (original traveling road) or one of branch roads, and may provide proper traffic information for the front side according to the determination.

In a road branch region, the traffic information for the front side of the original traveling road and the traffic information for the front side of a branch road are different from each other, and the existing navigation systems or the like may provide the traffic information for the front side of the road on which the vehicle is to travel only after the traveling road of the vehicle is finally determined.

However, according to the present invention, it is possible to predict in advance the road on which the vehicle is to advance before the vehicle completely enters into one of branch roads, and to properly provide the traffic information of the original traveling road or one of the branch roads, thereby improving the driver's convenience.

Meanwhile, as illustrated in FIG. 2, the first warning limit unit 130 may include, in addition to the road junction/branch region entry determining unit 134, a crossroad entry determining unit 135, a tollgate entry determining unit 136, a crosswalk region entry determining unit 137, and so on, and these components will be described below.

The crossroad entry determining unit 135 included in the first warning limit unit may confirm whether the vehicle enters into a crossroad using navigation map information, and when it is confirmed that the vehicle enters into a crossroad, the crossroad entry determining unit 135 may limit a lane departure warning.

In addition, the tollgate entry determining unit 136 included in the first warning limit unit may confirm whether the vehicle enters into a tollgate or a Hi-pass lane using navigation map information, and when it is confirmed that the vehicle enters into a tollgate or a Hi-pass lane, the tollgate entry determining unit 136 may limit a lane departure warning.

Of course, the crossroad entry determining unit 135 and the tollgate entry determining unit 136 may further use image information captured by a camera in addition to the navigation map information.

For example, through an analysis of the image captured by a camera, when it is confirmed that there is a front traffic light, in particular, a left turn/right turn signal sensed before entering into a crossroad, it may be determined that the vehicle enters into a crossroad.

Alternatively, by confirming a shape or color (blue) of a Hi-pass guide lane line located prior to the entry into a tollgate through an analysis of an image captured by a camera, it is possible to determine a state of entry into a tollgate.

Figure 6:
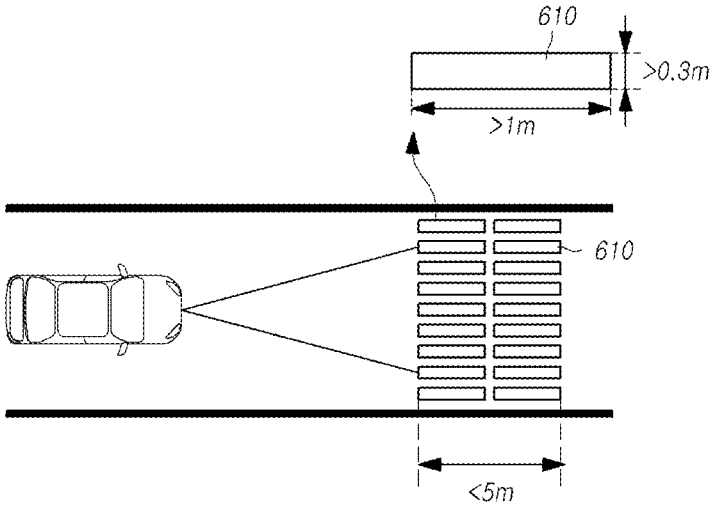
FIG. 6 illustrates an example of a method of determining entry into a crosswalk of a warning limiting unit according to the present invention.

FIG. 6 illustrates an example of a method of determining entry into a crosswalk of a warning limiting unit according to the present invention.

As illustrated in FIG. 6, when three or more similar patterns, each of which has a width of 30 cm or more and a length of 1 m or more, are detected within 5 m of the traveling road in lane information recognized from an captured image by a camera, the crosswalk region entry determining unit 137 included in the first warning limit unit may determine that the vehicle enters into a crosswalk region.

An identification pattern for indicating a crosswalk may have various forms according to a road environment, such as a road width or a crosswalk width. As a result of a simulation, it has been found that a crosswalk recognition rate is the highest when three or more similar patterns, each of which has a width of 30 cm or more and a length of 1 m or more, are detected within 5 mm on the traveling route, as described above.

Accordingly, the first warning limit unit according to the present invention may improve the reliability of the lane departure warning system by not making a lane departure determination or a lane departure warning in the case where the vehicle enters into a crosswalk by using the configuration of determining entry into a crosswalk as described above.

As illustrated in FIG. 1, the lane departure warning device according to the present invention may further include a second warning limit unit 140 configured to limit a lane departure warning by determining a driver's lane departure intention, in addition to the above-described first warning limit function.

In general, even in the state where an LKAS or an LDWS is activated, a driver may intentionally make a lane departure, for example, by changing the lane, and in such a case, the existing lane control systems may generate a lane departure warning, which may cause a disturbance to driving.

Accordingly, the second warning limit unit 140 according to the present invention receives information from various sensors of the vehicle so as to confirm the driver's lane departure intention, and, when the lane departure intention is confirmed, the second warning limit unit 140 makes a control such that a lane departure determination or a lane departure warning is not performed.

Specifically, when a transverse movement of the vehicle is made in excess of a predetermined extent (e.g., when a transverse velocity or a transverse acceleration received from a transverse acceleration sensor or estimated from a yaw rate sensor, a vehicle speed sensor, or the like exceeds a predetermined threshold value), the second warning limit unit 140 determines there is a driver's lane departure intention.

In addition, when the longitudinal velocity (vehicle speed) or longitudinal acceleration of the vehicle is in excess of a predetermined level, because it is probable that the vehicle makes a lane change according to a high velocity or sudden acceleration, it may be determined that there is the driver's lane departure intention.

In addition, when one of a steering angle received from a steering angle sensor of a steering device and a steering angle speed calculated therefrom is in excess of a predetermined level, it may be estimated that the driver intentionally operates the steering wheel so that it may be determined that the driver has a lane departure intention.

In addition, when a turn signal is turned ON, or until a predetermined length of time does not elapse after the turn signal has been turned OFF after turned ON, it may be estimated that the driver has a lane change intention so that it may be determined that the driver has a lane departure intention.

In addition, typically, when emergency signals or hazard lights are turned ON, it may mean that the driver sufficiently pay attention in driving the vehicle in an emergency state such as bad weather or the existence of a close obstacle in front of the vehicle, and both of the opposite turn signals are turned ON. Thus, in this case, the user's lane departure intention may not be determined.

Accordingly, the second warning limit unit 140 may determine the lane departure intention only when the emergency signals or the hazard lights are turned OFF.

Consequently, the second warning limit unit according to the present invention operates to limit a lane departure determination or a lane departure warning when it is confirmed that there is a driver's lane departure intention. The second warning limit unit may determine that the driver has a lane departure intention when one or more conditions are satisfied among first to third conditions as follows: the first condition in which at least one of the vehicle's transverse velocity, transverse acceleration, longitudinal velocity, steering angle, and steering angle speed exceeds a corresponding threshold value, the second condition in which a time period in which a turn signal has been turned ON or a time in which the turn signal has been turned OFF after turned ON does not elapse a threshold time, and the third condition in which the emergency signal is not turned ON.

As described above, when the lane departure warning device according to the present invention is used, it is possible to secure the reliability of a lane departure warning system and to provide a driver's convenience by limiting the lane departure warning in the case where the vehicle enters into a special road region, such as a road junction/branch region by comprehensively considering information captured by a camera of the vehicle, navigation map information, and so on while using a general lane departure warning, and also limiting the lane departure warning even in the case where the driver's lane departure intention is confirmed.

Meanwhile, a lane departure warning method according to the present invention may include: a lane recognizing step of recognizing a lane line around a lane on which a vehicle is traveling by using image information captured by a camera; a lane departure warning step of determining whether the vehicle departs from the lane line according to a relative position between the vehicle and the recognized lane line; a first warning limit step of confirming at least one of a road junction region and a road branch region in front of the vehicle by using at least one of the image information captured by the camera and navigation map information, and then, limiting the lane departure warning when the vehicle enters into the road junction region or the road branch region; and a second warning limit step of confirming a driver's lane departure intention by using information including at least one of the vehicle's transverse velocity, transverse acceleration, longitudinal acceleration, heading angle, steering angle, steering angle speed, operation/non-operation of a turn signal, and operation/non-operation of a hazard signal, and limiting the lane departure warning when the driver's lane departure intention is confirmed.

Figure 7:
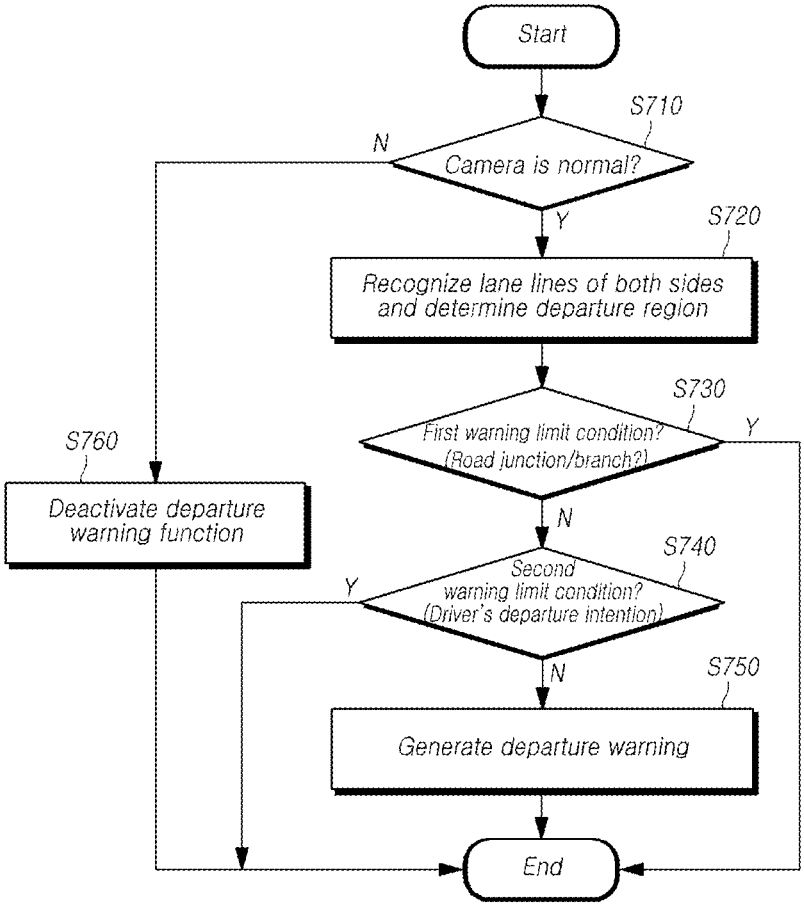
FIG. 7 illustrates an entire flow of a lane departure warning method according to one embodiment of the present invention.

FIG. 7 illustrates an entire flow of a lane departure warning method according to one embodiment of the present invention.

As in FIG. 7, first, it is confirmed whether the operation of the camera is normal (S710), and when the camera is abnormal, because the reliability of the lane departure sensing device cannot be ensured, the lane departure warning function is deactivated (S760).

When the camera normally operates, according to the above-described configuration, the lane recognizing unit 110 recognizes the lane lines of the both sides of the traveling lane, sets a departure warning region, and then determines whether the vehicle enters into the departure warning region (S720).

Next, by a configuration to be described with reference to FIGS. 8 and 9, the first warning limit unit 130 determines whether it is a first warning limit condition by confirming a road junction/branch region, or confirming whether or not to enter into a crossroad, enter into a tollgate, or enter into a crosswalk (S730).

When it is determined that it is the first warning limit condition in step S730, the process is terminated without performing the lane departure warning.

Meanwhile, when it is determined that it is not the first warning limit condition in step S730, the second warning limit unit 140 receives information from various sensors of the vehicle (e.g., a transverse velocity, a transverse acceleration, a longitudinal acceleration, a heading angle, a steering angle, a steering angle speed, operation/non-operation of a turn signal, and operation/non-operation of a hazard signal), and then determines whether there is a driver's lane departure intention by the above-described method (S740).

In step S750, when it is determined that it is the second warning limit condition (the driver's lane departure intention), the process is terminated without performing the lane departure warning, and only when it is determined that it does not correspond to any of the first warning limit condition and the second warning limit condition, the lane departure warning is generated.

Figure 8:
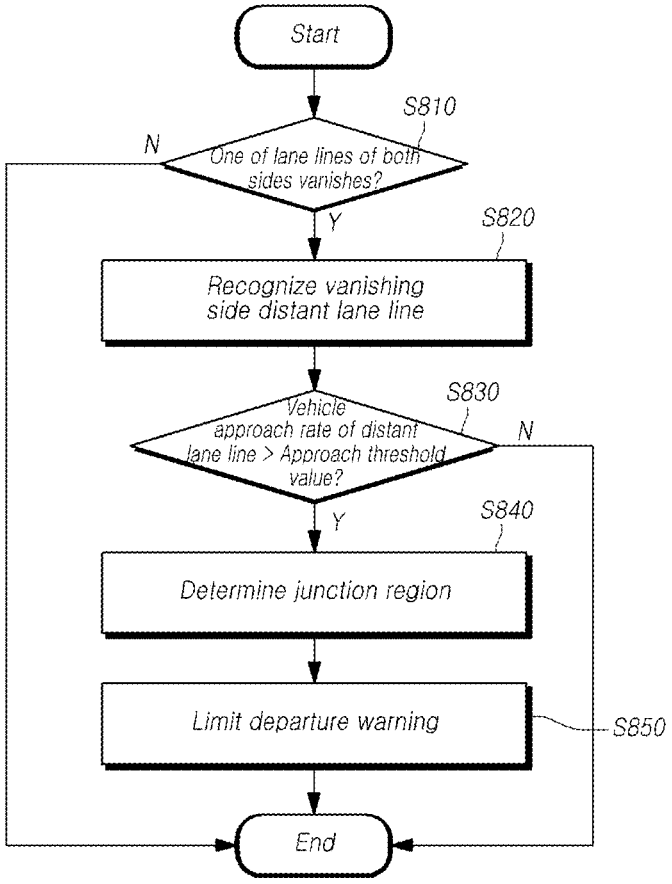
FIG. 8 is a flowchart of a method of determining a road junction region of the first warning limit unit according to the present invention.

FIG. 8 is a flowchart of a method of determining a road junction region of the first warning limit unit according to the present invention.

As in FIG. 8, the first warning limit unit 130 determines whether one of the lane lines of both sides of the road on which the vehicle is traveling vanishes by using the lane recognizing unit 110 (S810).

Next, the RoI of the lane recognizing unit 110 is enlarged to the vanishing side so as to recognize the vanishing side distant lane line (S820).

A vehicle approach rate of the vanishing side distant lane line is calculated and the vehicle approach rate of the vanishing side distant lane line and the approach threshold value are compared to each other (S830). When the vehicle approach rate of the vanishing side distant lane line exceeds the approach threshold value for a predetermined first determination distance S1, it is determined as a road junction region (S840).

Figure 9:
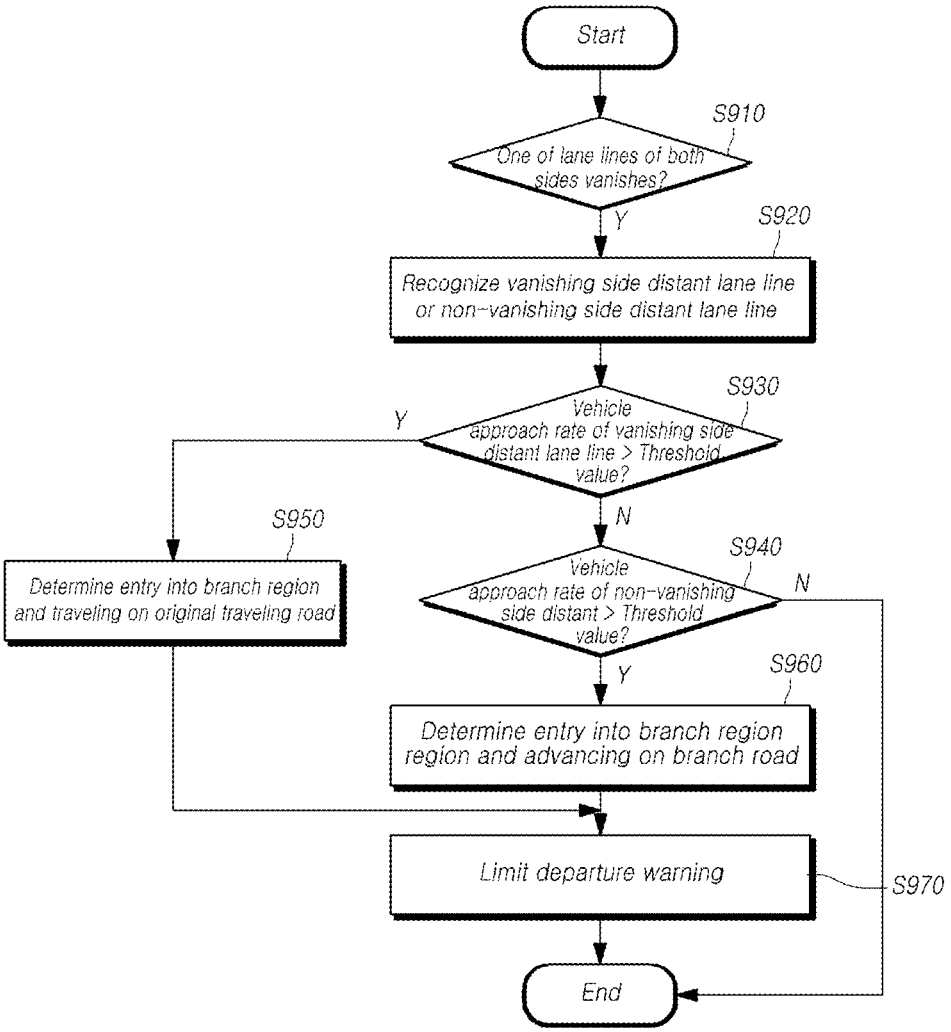
FIG. 9 is a flowchart of a method of determining a road branch region of the first warning limit unit according to the present invention.

FIG. 9 is a flowchart of a method of determining a road branch region of the first warning limit unit according to the present invention.

As in FIG. 9, the first warning limit unit 130 determines whether one of the lane lines of both sides of the road on which the vehicle is traveling vanishes by using the lane recognizing unit 110 (S910).

Next, the RoI of the lane recognizing unit 110 is enlarged to both the vanishing side and the non-vanishing side to as to recognize the vanishing side distant lane line or the non-vanishing side distant lane line (S920).

Next, a vehicle departure rate of the vanishing side distant lane line or the non-vanishing side distant lane line is calculated, and the vehicle departure rate of the vanishing side distant lane line and the departure threshold value are compared to each other (S930). When the vehicle approach rate of the vanishing side distant lane line exceeds the departure threshold value for a predetermined second determination distance S2, it is determined that the vehicle enters into a road branch region, and travels on the original traveling road of the road branch region (S950).

When the non-vanishing side distant lane line is recognized, the vehicle departure rate of the non-vanishing side distant lane line and the departure threshold value are compared to each other (S940). When the vehicle departure rate of the non-vanishing side distant lane line exceeds the departure threshold value for a predetermined second determination distance S2, it is determined that the vehicle enters into a road branch region, and travels on a branch road of the road branch region (S960).

As described above, according to the present invention, it is possible to secure the reliability of a lane departure warning system and to provide a driver's convenience by limiting the lane departure warning in the case where the vehicle enters into a special road region, such as a road junction/branch region by comprehensively considering information captured by a camera of the vehicle, navigation map information, and so on while using a general lane departure warning, and also limiting the lane departure warning even in the case where the driver's lane departure intention is confirmed.

Even when all the elements constituting an embodiment of the present invention have been described above as being combined into a single unit or combined to be operated as a single unit, the present invention is not necessarily limited to such an embodiment. That is, at least two elements of all structural elements may be selectively joined and operate without departing from the scope of the present invention. Although a preferred embodiment of the present invention has been described for illustrative purposes, those skilled in the art will appreciate that various modifications, additions and substitutions are possible, without departing from the scope and spirit of the invention as disclosed in the accompanying claims. The scope of the present invention shall be construed on the basis of the accompanying claims in such a manner that all of the technical ideas included within the scope equivalent to the claims belong to the present invention.

The invention claimed is:

1. An apparatus for assisting driving of a host vehicle, comprising:

an image sensor configured to detect lane lines of a traveling lane on which the host vehicle is traveling; and a controller communicatively connected to the image sensor, wherein the image sensor is configured to, in response to detection of a vanishing region where one of lane lines of the traveling lane vanishes, detect a distant lane line located opposite to the vanishing region with respect to the host vehicle, and the controller is configured to: determine whether the host vehicle enters into a road junction region based on information on the distant lane line located opposite to the vanishing region; and deactivate a lane departure warning in response to determination that the host vehicle enters into the road junction region.

2. The apparatus according to claim 1, wherein the controller is configured to periodically determine a distance from the host vehicle to the distant lane line and determine that the host vehicle enters into the road junction region if a decreasing rate of the distance is equal to or larger than a threshold value for a predetermined period of time.

3. The apparatus according to claim 1, further comprising:

a navigation device mounted to the host vehicle and configured to store map information, wherein the controller determines one or more warning deactivating conditions among the host vehicle's entry into a crossroad section, entry into a tollgate or an electronic toll collection section, and entry into a crosswalk region by using at least one of the image sensor or the navigation device, and then deactivates the lane departure warning when the host vehicle enters into any of the warning deactivating conditions.

4. The apparatus according to claim 1, wherein the controller is further configured to: determine whether there is a driver's lane departure intention by using information including at least one of the host vehicle's transverse velocity, transverse acceleration, longitudinal acceleration, heading angle, steering angle, steering angle speed, a hazard signal, or operation of a turn signal; and deactivate the lane departure warning if it is determined that there is the driver's lane departure intention.

5. The apparatus according to claim 1, wherein the controller is further configured to determine whether the image sensor has a functional failure and deactivate the lane departure warning if it is determined that the image sensor has the functional failure.

6. An apparatus for assisting driving of a host vehicle, comprising:

an image sensor configured to detect lane lines of a traveling lane on which the host vehicle is traveling; and a controller communicatively connected to the image sensor, wherein the controller is configured to: in response to the image sensor's detecting an angled region where one lane line of both lane lines of the traveling lane is angled in an outward direction, determine whether the host vehicle enters into a road branch region based on information on an other lane line of the traveling lane; and deactivate a lane departure warning in response to determination that the host vehicle enters into the road branch region.

7. The apparatus according to claim 6, wherein the controller is configured to periodically determine a distance from the host vehicle to the other lane line and determine that the host vehicle enters into the road branch region if an increasing rate of the distance is equal to or larger than a threshold value for a predetermined period of time.

8. The apparatus according to claim 6, further comprising:

a navigation device mounted to the host vehicle and configured to store map information, wherein the controller determines one or more warning deactivating conditions among the host vehicle's entry into a crossroad section, entry into a tollgate or an electronic toll collection section, and entry into a crosswalk region by using at least one of the image sensor or the navigation device, and then deactivates the lane departure warning when the host vehicle enters into any of the warning deactivating conditions.

9. The apparatus according to claim 6, wherein the controller is further configured to: determine whether there is a driver's lane departure intention by using information including at least one of the host vehicle's transverse velocity, transverse acceleration, longitudinal acceleration, heading angle, steering angle, steering angle speed, a hazard signal, or operation of a turn signal; and deactivate the lane departure warning if it is determined that there is the driver's lane departure intention.

10. The apparatus according to claim 6, wherein the controller is further configured to determine whether the image sensor has a functional failure and deactivate the lane departure warning if it is determined that the image sensor has the functional failure.

11. A method for assisting driving of a host vehicle, comprising:

detecting lane lines of a traveling lane on which the host vehicle is traveling by using an image sensor;

detecting a vanishing region where one of lane lines of the traveling lane vanishes by using the image sensor;

detecting a distant lane line located opposite to the vanishing region with respect to the host vehicle by using the image sensor;

determining whether the host vehicle enters into a road junction region based on information associated with the distant lane line located opposite to the vanishing region with respect to the host vehicle; and deactivating a lane departure warning in response to determination that the host vehicle enters into the road junction region.

12. The method according to claim 11, wherein the determining whether the host vehicle enters into the road junction region comprises: periodically determining a distance from the host vehicle to the distant lane line; and determining that the host vehicle enters into the road junction region if a decreasing rate of the distance is equal to or larger than a threshold value for a predetermined period of time.

13. The method according to claim 11, further comprising:

determining whether there is a driver's lane departure intention by using information including at least one of the host vehicle's transverse velocity, transverse acceleration, longitudinal acceleration, heading angle, steering angle, steering angle speed, a hazard signal, or operation of a turn signal; and deactivating the lane departure warning if it is determined that there is the driver's lane departure intention.

14. The method according to claim 11, further comprising:

determining whether the image sensor has a functional failure; and deactivating the lane departure warning if it is determined that the image sensor has the functional failure.

15. A method for assisting driving of a host vehicle, comprising:

detecting lane lines of a traveling lane on which the host vehicle is traveling by using an image sensor;

detecting an angled region where a one lane line of both lane lines of the traveling lane is angled in an outward direction by using the image sensor;

determining whether the host vehicle enters into a road branch region based on information on an other lane line of the traveling lane; and deactivating a lane departure warning in response to determination that the host vehicle enters into the road branch region.

16. The method according to claim 15, wherein the determining whether the host vehicle enters into the road branch region comprises: periodically determining a distance from the host vehicle to the other lane line; and determining that the host vehicle enters into the road junction region if an increasing rate of the distance is equal to or larger than a threshold value for a predetermined period of time.

17. The method according to claim 15, further comprising:

determining whether there is a driver's lane departure intention by using information including at least one of the host vehicle's transverse velocity, transverse acceleration, longitudinal acceleration, heading angle, steering angle, steering angle speed, a hazard signal, or operation of a turn signal; and deactivating the lane departure warning if it is determined that there is the driver's lane departure intention.

18. The method according to claim 15, further comprising:

determining whether the image sensor has a functional failure; and deactivating the lane departure warning if it is determined that the image sensor has the functional failure.

* * * * *